US008020353B2

(12) United States Patent
Gaudreau

(10) Patent No.: US 8,020,353 B2
(45) Date of Patent: Sep. 20, 2011

(54) POLYMER BUILDING PRODUCTS

(75) Inventor: Michel Gaudreau, Quebec (CA)

(73) Assignee: Novik, Inc., Saint-Augustin-de-Desmaures (CA)

( * ) Notice: Subject to any disclaimer, the term of this patent is extended or adjusted under 35 U.S.C. 154(b) by 0 days.

(21) Appl. No.: 12/359,813

(22) Filed: Jan. 26, 2009

(65) Prior Publication Data

US 2010/0088988 A1 Apr. 15, 2010

Related U.S. Application Data

(60) Provisional application No. 61/105,613, filed on Oct. 15, 2008.

(51) Int. Cl.
*E04D 1/34* (2006.01)

(52) U.S. Cl. ..... 52/520; 52/523; 52/526; 52/547; 52/543; 52/549; 52/550; 52/551

(58) Field of Classification Search ..... 52/309.1, 52/543–544, 546–547, 553, 555, 573.1, 520–529, 52/557–559, 582.1, 587.1, 586.1, 586.2, 52/585.1

See application file for complete search history.

(56) References Cited

U.S. PATENT DOCUMENTS

| | | | | |
|---|---|---|---|---|
| 1,447,561 A | | 3/1923 | Overbury | |
| 1,467,510 A | | 9/1923 | Smith, Jr. | |
| 1,767,374 A | | 6/1930 | Kirschbraun | |
| 1,795,913 A | | 3/1931 | Weaver | |
| 2,096,968 A | | 10/1937 | Johnston | |
| 2,135,811 A | * | 11/1938 | Goslin | 52/542 |
| 2,648,103 A | * | 8/1953 | Wahlfeld | 52/471 |
| 3,504,467 A | | 4/1970 | Hatch | |
| 3,754,366 A | | 8/1973 | Jansson et al. | |
| 3,973,369 A | | 8/1976 | Smith | |
| 3,977,145 A | * | 8/1976 | Dobby et al. | 52/531 |
| 4,015,391 A | | 4/1977 | Epstein | |
| 4,033,499 A | | 7/1977 | Butler | |
| 4,034,528 A | * | 7/1977 | Sanders et al. | 52/309.4 |

(Continued)

FOREIGN PATENT DOCUMENTS

JP 10183935 A * 7/1998

(Continued)

OTHER PUBLICATIONS

Vande Hey Raleigh. http://www.vhr-roof-tile.com/index.htm [retrieved Feb. 18, 2009].

(Continued)

*Primary Examiner* — Jeanette E. Chapman
(74) *Attorney, Agent, or Firm* — Dickinson Wright

(57) ABSTRACT

In polymer building products, such as polymer siding, polymer roofing, j-blocks, gable vents, etc., characterized by fastener apertures each comprising an elongate slot bounded by a peripheral wall defining the slot, the peripheral wall having a height, a fastener centering-guide comprising a layer of material extending into the elongate slot from the peripheral wall thereof, the layer of material having defined therein (a) an elongate opening that is generally parallel to, but of smaller transverse dimensions than, the elongate slot, and (b) a predetermined location, defined intermediate the length of the elongate opening, for receiving a fastener therethrough, and wherein further the layer of material is characterized by a thickness that is less than the height of the peripheral wall and sufficiently thin so as to permit relative movement between a fastener extending through the centering guide and the polymer building product.

26 Claims, 7 Drawing Sheets

U.S. PATENT DOCUMENTS 4,070,432 A 1/1978 Tamaddon
4,070,843 A * 1/1978 Leggiere et al. ..... 52/521
4,096,679 A 6/1978 Naz
4,104,841 A 8/1978 Naz
4,219,981 A 9/1980 Stewart et al.
4,251,967 A 2/1981 Hoofe, III
4,288,959 A 9/1981 Murdock
4,319,439 A * 3/1982 Gussow ..... 52/288.1
4,343,126 A 8/1982 Hoofe, III
4,382,993 A 5/1983 McIntyre et al.
4,434,200 A 2/1984 Fash et al.
4,437,602 A 3/1984 Kaczmarek
4,445,301 A 5/1984 Tanski
4,472,913 A 9/1984 Hickman
4,476,661 A 10/1984 Hoofe, III
4,498,267 A 2/1985 Beck
4,499,702 A 2/1985 Turner
4,522,002 A 6/1985 Davis
4,544,595 A 10/1985 Tomason
4,580,383 A 4/1986 Pittman et al.
4,588,634 A 5/1986 Pagen et al.
4,592,185 A 6/1986 Lynch et al.
4,598,522 A 7/1986 Hoofe, III
4,617,770 A 10/1986 Hickman
4,617,774 A 10/1986 Pittman et al.
4,618,440 A 10/1986 Steinberg et al.
4,627,207 A 12/1986 Young et al.
4,641,472 A 2/1987 Young et al.
4,663,373 A 5/1987 Ravichandran et al.
4,671,753 A 6/1987 Payne
4,671,991 A 6/1987 Payne
4,680,911 A * 7/1987 Davis et al. ..... 52/521
4,712,351 A 12/1987 Kasprzak
4,717,614 A 1/1988 Bondoc et al.
4,729,202 A 3/1988 Ferland
4,749,533 A 6/1988 Payne
4,777,776 A 10/1988 Morrell
4,782,638 A 11/1988 Hovind
4,795,661 A 1/1989 Bondoc et al.
4,798,033 A 1/1989 Weide
4,803,144 A 2/1989 Hosoi
4,825,616 A 5/1989 Bondoc et al.
4,879,333 A 11/1989 Frazee
4,890,432 A 1/1990 Shepherd
4,936,071 A 6/1990 Karrfalt
4,940,844 A 7/1990 Blunt
4,946,992 A 8/1990 Falk et al.
5,039,740 A 8/1991 Anderson et al.
5,047,556 A 9/1991 Kohler et al.
5,072,562 A * 12/1991 Crick et al. ..... 52/533
5,076,037 A 12/1991 Crick
5,084,506 A 1/1992 Faler et al.
5,088,910 A 2/1992 Goforth et al.
5,096,046 A 3/1992 Goforth et al.
5,100,274 A 3/1992 Hasan et al.
5,106,609 A 4/1992 Bolich, Jr. et al.
5,124,098 A 6/1992 Vischer
5,126,392 A 6/1992 Nakashima
5,135,971 A 8/1992 Steirt et al.
5,141,983 A 8/1992 Hasegawa et al.
5,186,980 A 2/1993 Koschitzky
5,188,895 A 2/1993 Nishino
5,224,318 A 7/1993 Kemerer
5,229,207 A 7/1993 Paquette et al.
D339,875 S 9/1993 Schutz
5,249,402 A 10/1993 Crick
5,277,009 A * 1/1994 Yamaguchi et al. ..... 52/387
5,287,669 A 2/1994 Hannab et al.
5,288,787 A 2/1994 Sackmann et al.
5,295,339 A 3/1994 Manner
5,305,569 A 4/1994 Malmquist et al.
5,305,570 A * 4/1994 Rodriguez et al. ..... 52/520
5,344,007 A 9/1994 Nakamura et al.
5,347,784 A * 9/1994 Crick et al. ..... 52/520
5,349,802 A 9/1994 Kariniemi
5,363,623 A 11/1994 King
5,375,491 A 12/1994 Hannah et al.
5,400,558 A 3/1995 Hannah et al.
RE34,951 E 5/1995 Slosberg et al.
5,416,151 A 5/1995 Tanaka
5,421,134 A 6/1995 Hannah et al.
5,437,735 A 8/1995 Younan et al.
5,501,056 A 3/1996 Hannah et al.
5,524,412 A 6/1996 Corl
5,537,792 A * 7/1996 Moliere ..... 52/531
5,575,861 A 11/1996 Younan et al.
5,577,361 A 11/1996 Grabek, Jr. et al.
5,586,415 A * 12/1996 Fisher et al. ..... 52/58
5,592,799 A 1/1997 Reinke
5,622,020 A * 4/1997 Wood ..... 52/546
5,635,125 A 6/1997 Ternes et al.
5,675,955 A * 10/1997 Champagne ..... 52/521
5,687,090 A 11/1997 Chen et al.
5,731,033 A 3/1998 Hanisco
5,763,083 A 6/1998 Berrigan
5,813,184 A 9/1998 McKenna
5,821,294 A 10/1998 Pertinski
5,853,858 A 12/1998 Bondoc
5,878,543 A 3/1999 Mowery
5,922,379 A 7/1999 Wang
5,956,914 A 9/1999 Williamson
5,960,596 A 10/1999 Lyons, Sr.
5,992,116 A 11/1999 Ternes et al.
6,038,827 A 3/2000 Sieling
6,044,609 A 4/2000 Kim
6,050,041 A 4/2000 Mowery et al.
6,058,670 A 5/2000 Sieling
6,092,302 A 7/2000 Berrigan
6,105,329 A 8/2000 Bondoc et al.
6,114,007 A 9/2000 Brandon et al.
6,122,878 A 9/2000 Pliley
6,153,293 A 11/2000 Dahl et al.
6,180,257 B1 1/2001 Brandt et al.
6,248,813 B1 6/2001 Zehner
6,258,876 B1 7/2001 Medoff et al.
6,282,858 B1 9/2001 Swick
6,301,856 B1 10/2001 Nasi
6,336,303 B1 * 1/2002 Vandeman et al. ..... 52/520
6,361,851 B1 3/2002 Sieling et al.
6,421,975 B2 7/2002 Bryant
6,436,471 B1 8/2002 Petersen
6,487,828 B1 12/2002 Phillips
6,550,362 B1 4/2003 Galient et al.
6,579,605 B2 6/2003 Zehner
6,715,240 B2 4/2004 Beck et al.
6,715,250 B2 * 4/2004 Bryant et al. ..... 52/528
6,786,804 B2 9/2004 Watanabe
6,939,036 B2 9/2005 Beck et al.
6,955,019 B2 10/2005 Donlin
6,976,342 B1 * 12/2005 Kowalevich ..... 52/546
6,983,571 B2 1/2006 Felton
7,089,709 B2 8/2006 Waggoner
7,207,145 B2 * 4/2007 Stucky et al. ..... 52/555
7,918,065 B2 * 4/2011 Ito ..... 52/506.05
2001/0039778 A1 11/2001 King
2003/0182888 A1 10/2003 Desbois et al.
2005/0102946 A1 * 5/2005 Stucky et al. ..... 52/518
2007/0107356 A1 5/2007 Steffes et al.
2007/0144096 A1 6/2007 O'Neal
2008/0296451 A1 * 12/2008 Yoshida et al. ..... 248/220.1

FOREIGN PATENT DOCUMENTS

JP 11107486 A * 4/1999

OTHER PUBLICATIONS

Slate Roof Tile. Our product. [online]. Vande Hey Raleigh [retrieved on Feb. 18, 2009]. Retrieved from the internet.<vhr-roof-tile.com/products_modernslate.htm>.

Riviera Concrete Roof Tile. our products [online] Vande Hey Raleigh [retrieved on Feb. 18, 2009] Retrieved from Internet <URL www.vhr-roof-tile.com/products_Riviera.htm>.

Max Slate General Information. Products. Installation Manuals [online]. Max Roofing Products [retrieved Feb. 18, 2009] Retrieved from internet: <URL:www.maxroffingproducts.com/Manuals/Max%20Slate%20General%2Cinfo.doc>.

Majestic Slate Product Technical Data. Products. Majestic Slate Traditional. Product Technical Data-Class-C [online] Carlisle Syntec Incorporated Ecostar, 2004 [retrieved on Feb. 18, 2009] Retrieved from Internet: <URL:www.ecostar.carlisle.com/PDFs/802701-MAJESTIC%20SLATE%2OPTD-1%20.new.pdf.
Dura Slate Roofing Systems. Products [online] Royal Building Products [retrieved from the Internet <URL:www.royalbuildingproducts.com/html/products/shake/profilespecs.html> [retrieved Feb. 18, 2009].
Max Slate Product Information Sheet. Products. Literature [online]. Max Roofing Products [retrived on Feb. 18, 2009] Retrieved from the Internet<URL:www.maxroofingproducts.com/Literature/Max-Slate.pdf>.
Max Slate Lab Testing Summary. Products. Literature [online] Max Roofing Products [retrieved on Feb. 18, 2009] Retrieved from Internet: <URL:www.maxroofingproducts.com/Literature/MAX-Slate.pdf>.
Majestic Slate. Eco-Star Installation Guides [online] Carlisle Syntec Incorporated Ecostar [retrieved on Feb. 18, 2009] Retrieved from Internet: <URL:www.ecostar.carlisle.com/PDFs/802701-MAJESTIC%20SLATE% 2OPTD-1%20new.pdf.

* cited by examiner

POLYMER BUILDING PRODUCTS

RELATED APPLICATIONS

This application claims the benefit of priority from U.S. provisional application Ser. No. 61/105,613, filed Oct. 15, 2008.

FIELD OF THE INVENTION

The present invention pertains to the field of polymer building products, such as, for example, siding, roofing, J-blocks, gable vents, siding joints, etc., and more particularly to an improved, polymer siding-joint for concealing the opposing lateral edges of horizontally adjacent pieces of polymer siding, improved means for ensuring the accurate and facile installation of siding and roofing panels, as well as a fastener centering-guide and a hammer stop for incorporation into polymer building products.

BACKGROUND

While the advent of polymer building products has greatly eased the installation of roofing, siding and trim components, drawbacks remain.

To facilitate their installation, polymer building products, such as, for example, siding, roofing, J-blocks, gable vents, etc., are usually characterized by a plurality of fastener apertures each comprising an elongate slot of constant width bounded by a peripheral wall defining the slot. In these regards, the disclosure of the applicant's own prior-published application, US Pub. No. 20080083186, the disclosure of which is incorporated herein by reference in its entirety, is exemplary. In installation, a fastener, such as a nail, for instance, is driven through each slot and into a substrate to thus secure the building product in place. The slots are elongate so that once a fastener is positioned therein and secured to the underlying substrate, the building products can slide relative to the fasteners as the polymer material expands and contracts due to changing ambient temperatures.

Necessarily, the fasteners must be positioned approximately in the middle of each slot in order to permit the unfettered relative movement of the building products in either direction so as to accommodate both contraction and expansion of the building products. Unfortunately, hasty installation can lead to the misplacement of fasteners too close to one or the other end of these slots. When this occurs, the slot end confronts the fastener prematurely during its relative movement, leading to unwanted buckling of the building product.

Another common occurrence during installation of polymer building products is for fasteners to be driven too deeply into the substrate, such that the building product is effectively fixed in position and unable to move relative to the fastener in response to changes in the ambient temperature. As with misplacement of the fastener within the slot, this installation error can lead to unwanted buckling of the building product.

Still a further problem in the installation of polymer siding and roofing panels is the need to ensure proper alignment of vertically adjacent rows of siding or roofing panels as they are "stacked" one on top of the other. With conventional polymer roofing and siding panels, it is possible to misalign vertically successive panels relative to the preceding, vertically lower one, unless due care is taken by the installer. However, such due care can slow the installation process.

A further drawback of polymer siding is that the necessity, in some installation methods, of leaving a slight gap between horizontally adjacent panels (to ensure sufficient room for the panels to expand and contract due to changes in ambient temperature) creates an unsightly aesthetic to the thus-finished building. While siding-joints are known as a satisfactory means for concealing such gaps, the conventional forms of these joints are difficult to install.

SUMMARY OF THE DISCLOSURE

The present invention addresses the foregoing problems of the prior art in the provision of improvements to polymer building products, such as polymer siding, polymer roofing, j-blocks, gable vents, etc.

According to a first aspect of the invention, there is provided a fastener centering-guide comprising a layer of material extending into the elongate slot from the peripheral wall thereof, the layer of material having defined therein (a) an elongate opening that is generally parallel to, but of smaller transverse dimensions than, the elongate slot, and (b) a predetermined location, defined intermediate the length of the elongate opening, for receiving a fastener therethrough, and wherein further the layer of material is characterized by a thickness that is less than the height of the peripheral wall and sufficiently thin so as to permit relative movement between a fastener extending through the centering guide and the polymer building product.

According to one feature, the predetermined location for receiving a fastener through the layer of material comprises an opening of a first size, and the elongate opening comprises a pair of slots extending oppositely from the opening, each slot being characterized by smaller transverse dimensions than the opening.

The layer of material may be formed of polymer, for example, and may be formed integrally with the peripheral wall or as a separate element that is fixedly secured to the peripheral wall.

In another aspect thereof the invention comprises a siding joint for concealing the gap between opposing lateral edges of horizontally adjacent pieces of siding, the siding joint having a bottom portion adapted to be secured to a substrate beneath, and proximate the opposite lateral edges of, horizontally adjacent pieces of siding; and a top portion connectable to the bottom portion so as to capture therebetween horizontally adjacent pieces of siding, the top portion concealing the opposing lateral edges of horizontally adjacent pieces of siding.

Per one feature, the top portion comprises an outwardly-facing surface simulating the appearance of a natural siding material.

Per another feature, the top and bottom portions comprise interlocking elements by means of which the top portion is connectable to the bottom portion.

Per another feature, the bottom portion is a generally wedge-shaped element that tapers in thickness along a longitudinal axis thereof.

According to a still further feature, the bottom portion comprises a plurality of spaced openings therein. At least one locking tab extends into each said opening. Further according to this feature, the top portion comprises a plurality of rigid supports corresponding in number to the number of the plurality of openings in the bottom portion, each said rigid support terminating in a foot engageable by the at least one tab in the corresponding opening.

According to yet another feature, the bottom portion comprises a plurality of laterally spaced-apart deformable or frangible projections dimensioned to abut the opposing lateral edges of horizontally adjacent pieces of siding. The projections are adapted to be deformable or frangible in response to the force of a siding panel's lateral edge acting against the projections during expansion of the panel as occasioned by changes in ambient temperature.

Per still another feature, the bottom portion further comprises a plurality of laterally extending ribs dimensioned to be able to support overlying siding.

According to a further aspect thereof, the invention comprehends a hammer stop for limiting the depth to which a fastener may be driven into each elongate slot comprising the fastener apertures of a polymer building product. The hammer stop comprises vertically elevated, rigid stop surfaces, the stop surfaces positioned about each elongate slot so as to confront the face of a hammer having a head diameter greater than the distance between the stop surfaces, and the stop surfaces being vertically elevated above each elongate slot by a distance sufficient to prevent a fastener from being driven into the slot to a depth at which the building product is prevented from moving relative to the fastener during expansion and contraction of the building product.

Per one feature thereof, the hammer stop comprises a pair of elongate ribs disposed oppositely of the elongate slot and longitudinally extending in a direction generally parallel to the longitudinal axis of the elongate slot.

Per still another feature, the fastener apertures are disposed serially along a length of the building product, and wherein the improvement further comprises the pair of elongate ribs extending continuously and generally coextensively with the fastener apertures.

In another aspect thereof, the invention comprehends a polymer roofing or siding panel, comprising a front, outwardly-facing decorative surface and an opposite, rearwardly facing surface, a top edge and a vertically spaced-apart bottom edge; a first stand-off positioned proximate the top edge of the roofing or siding panel, the stand-off projecting rearwardly from the rearwardly facing surface, and the stand-off engageable with a substrate to define a gap between the siding or roofing panel and a substrate in the area immediately above the stand-off; and a hook positioned proximate the bottom edge of the roofing or siding panel and projecting from the rearwardly facing surface thereof, the hook opening toward the bottom edge of the roofing or siding panel so as to be slidingly receivable in the said gap defined in a like, vertically adjacent roofing or siding panel.

Per one feature of the invention, the first stand-off is a continuous element extending generally coextensively with the length of the roofing or siding panel.

Per another feature, the hook is defined by a rearwardly projecting element that terminates in a portion extending downwardly toward the bottom edge of the roofing or siding panel.

According to still another feature, the hook is a continuous element extending generally coextensively with the length of the roofing or siding panel.

According to yet another feature, the hook is a discrete element disposed along the length of the roofing or siding panel.

Per a still further feature, a plurality of discrete hooks are disposed along the length of the roofing or siding panel.

BRIEF DESCRIPTION OF THE DRAWINGS

The present invention may be better understood with reference to the written description and drawings, of which.

DETAILED DESCRIPTION

As required, detailed embodiments of the present invention are disclosed herein. However, it is to be understood that the disclosed embodiments are merely exemplary of the invention that may be embodied in various and alternative forms. The accompanying drawings are not necessarily to scale, and some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
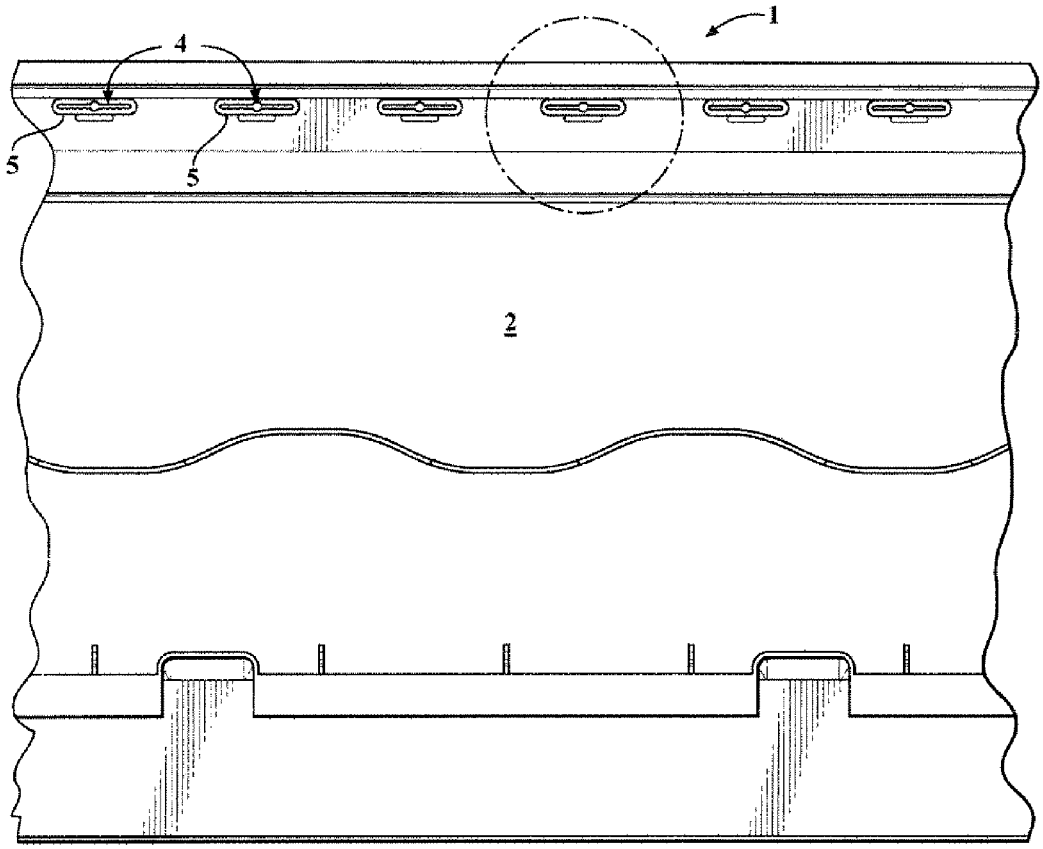
FIG. 1 comprises a rear plan-view of a section of a polymer building product according to the present invention.
Figure 4:
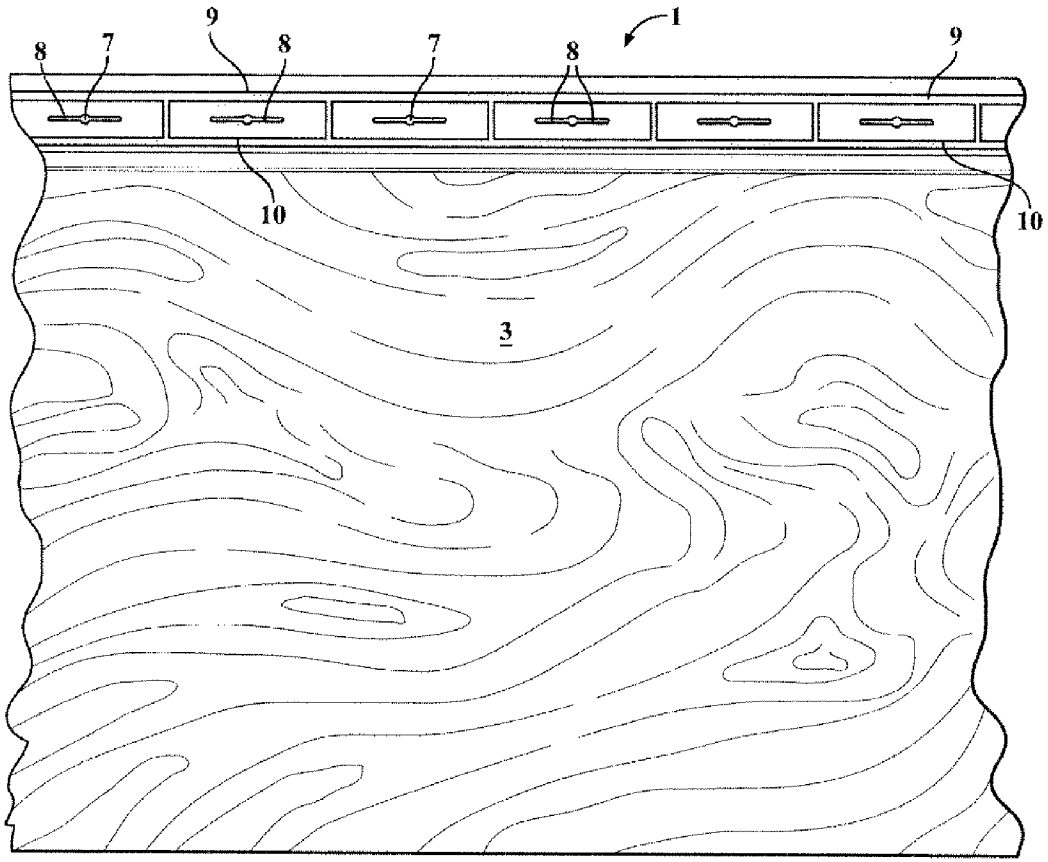
FIG. 4 comprises a front plan-view of the building product of FIG. 1.

Referring now to the drawings, wherein like numerals refer to like or corresponding parts, the present invention will be seen to most generally comprise improvements to polymer building products, such as polymer siding, polymer roofing, j-blocks, gable vents, etc. According to a first such improvement, shown in FIGS. 1 through 4, there is provided a fastener centering-guide for facilitating the proper positioning of fasteners (e.g., nails) within each fastener slot so that subsequent relative movement of the building product in response to changes in ambient temperature is possible. More particularly according to the illustrated embodiment, there is provided a polymer siding panel 1 having a rear surface 2 (FIG. 1) facing inwardly toward a substrate (not shown) and a front, outwardly-facing decorative surface 3 (FIG. 4). To facilitate securement of the panel 1 to the substrate, there are provided a plurality of fastener apertures (indicated generally at 4). Viewed from the rear surface 2 (FIGS. 1 and 2) as well as in cross-section (FIG. 3), each such aperture 4 will be seen to comprise, according to convention, an elongate slot bounded and defined by a peripheral wall 5.

Figure 2:
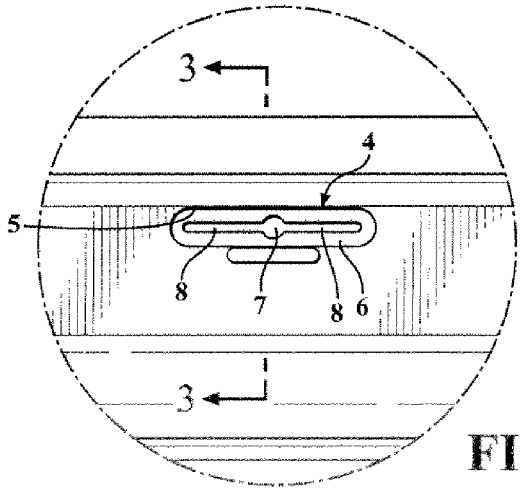
FIG. 2 comprises a detailed view of a portion of the building product of FIG. 1.
Figure 3:
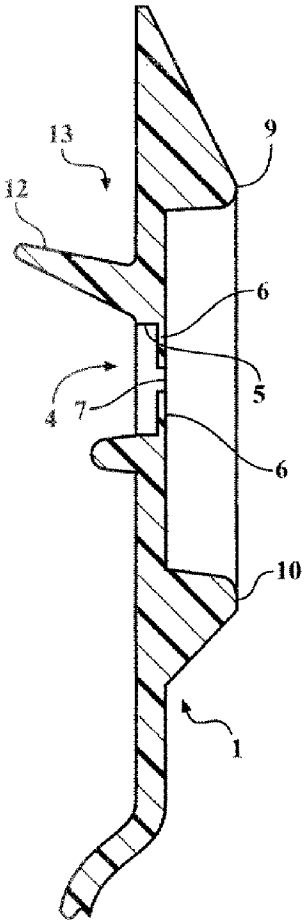
FIG. 3 is a cross-section of the building product of FIG. 2, taken along lines 3.

Referring more particularly to FIGS. 2 and 3, a fastener centering-guide is further provided within the area of each slot defined by the wall 5, the centering-guide generally comprising a layer of material 6 extending or protruding into the elongate slot from the peripheral wall 5. The layer of material 6 has defined therein an elongate opening 8 that is generally parallel to, but of smaller transverse dimensions than, the elongate slot defined by the wall 5. Elongate opening 8 may be defined by a slit in the layer of material or, as desired, by a slot of transverse dimensions.

Further defined in the layer of material intermediate the length of the elongate opening 8 is a predetermined location 7 for receiving a fastener, such as, for instance, a nail (not shown), therethrough. In the illustrated embodiment, this predetermined location 7 is depicted as an opening the dimensions of which are sufficient to permit the shank of a fastener such as a nail to pass freely therethrough. According to this embodiment, the elongate opening 8 is a slot characterized by smaller transverse dimensions than the opening of location 7 so as to thereby distinguish the preferred approximate location for positioning a fastener.

It will be appreciated that the dimensions of the location 7 may be smaller or larger than as shown, subject only to the need for the location 7 to clearly identify for an installer the preferred approximate location for positioning a fastener within the slot defined by the wall 5. Thus, for instance, it is contemplated that the location 7 may simply comprise indicia, such as an "X," positioned along the length of the elongate opening 8 for identifying the preferred position for the fastener to be driven into the layer of material.

Referring specifically to FIG. 3, the layer of material 6 will be seen to be characterized by a thickness that is less than the height of the peripheral wall 5. This thickness of the layer of material 6 is sufficiently thin so as to permit relative movement between the fastener (not shown) extending through the centering guide and the polymer building product, as occasioned by changes in ambient temperature which cause expansion and contraction of the polymer material of the building product.

Further to the illustrated embodiment, the layer of material 6 is a polymer which may be formed with the siding panel 1 or other building product so as to be integral therewith. Alternatively, the layer of material 6 may be formed separately and subsequently fixed in place, such as with adhesives, over the elongated slots. It will also be appreciated that the layer of material need not be formed of polymer, being formed instead, for example, from fabric, cellulose, etc.

According to a second improvement to building products encompassed by the present disclosure, also shown in FIGS. 3 and 4, there is provided a hammer stop for limiting the depth to which a fastener may be driven into each elongate slot defined by the peripheral wall 5, thereby preventing the building product from being fixed immovably in place against the substrate. Generally, the hammer stop comprises vertically elevated, rigid stop surfaces 9, 10 positioned about each elongate slot (defined by the peripheral wall 5) so as to confront the face of a hammer having a head diameter greater than the distance between the stop surfaces 9, 10.

According to the illustrated embodiment of FIGS. 3 and 4, in which the hammer stop is shown in conjunction with siding panel 1, the rigid stop surfaces 9, 10 of the hammer stop define a pair of elongate ribs disposed oppositely of the fastener apertures 4 and longitudinally extending in a direction generally parallel to the longitudinal axis of each elongate slot (defined by the peripheral wall 5).

Each stop surface 9, 10 is further defined in cross-section (FIG. 3) as a raised shoulder extending the length of the panel 1 generally coextensive with the series of fastener apertures 4. The vertical distance between each stop surface 9, 10 and the elongate slot defined by peripheral wall 5 is such as to ensure that, during installation of the building product (e.g., the siding panel 1) with a hammer having a head diameter greater than the distance between the opposing stop surfaces 9, 10, a fastener can be driven through the slot and into the underlying substrate only so far as to a depth which leaves sufficient space for the building product to move relative to the fastener during expansion and contraction.

Referring next to FIGS. 5 through 12, a further improved building product according to the present disclosure comprises a polymer siding joint for concealing the gap between opposing lateral edges of horizontally adjacent pieces of siding, the siding joint comprising a bottom portion 20 adapted to be secured to a substrate beneath, and proximate the opposite lateral edges of, horizontally adjacent pieces of siding (1 and 1' in FIGS. 11 and 12), and a top portion 30 connectable to the bottom portion 20 so as to capture therebetween horizontally adjacent pieces of the siding 1, 1', the top portion 30 concealing the opposing lateral edges of horizontally adjacent pieces of siding.

Referring more specifically to FIGS. 5 through 8, the top portion 30 comprises a generally planar member having a front, outwardly-facing decorative surface 31 which may be fashioned to match the appearance of the outwardly-facing decorative surfaces of the siding panels. For instance, the outwardly-facing surface 31 may simulate the appearance of a natural siding material, such as wood. This generally planar member of the top portion is, as indicated, at least of sufficient dimensions in both width and length so that, in use (described hereafter), it substantially conceals the opposing lateral edges of horizontally adjacent pieces of siding and the gap which must of necessity be left therebetween during installation so as to permit expansion of the siding due to changes in ambient temperature.

From the rear, inwardly facing surface 32 there project a plurality of rigid supports 33 interconnected at their bases by a rib 34. The end of each support 33 terminates in a generally planar foot 35 oriented substantially normal to the support. As depicted best in FIG. 5, each foot 35 is characterized on either side of the support 33 by a forward edge 36 which slopes upwardly toward the rear surface 32, then terminating abruptly in a surface 37 disposed generally perpendicular to the plane of the foot 35.

Referring next to FIGS. 5, 6, 9 and 10, the bottom portion 20 is, in profile (FIGS. 5 and 6), a generally wedge-shaped member the taper of which corresponds to the taper of the polymer siding installed thereover. One or more recessed or counter-bored openings 21 are provided through the bottom portion 20, each opening 21 dimensioned to receive therethrough a fastener (e.g., a nail) whereby the bottom portion may be fixed to a substrate. As shown in the exemplary embodiment, openings 21 are offset relative to the longitudinal centerline of the bottom portion 20, being disposed, more particularly, proximate the right hand side of the bottom portion as shown.

Extending laterally from the bottom portion 20 are a plurality of ribs 22 dimensioned to support the rear surface of siding lying thereover.

Figure 6:
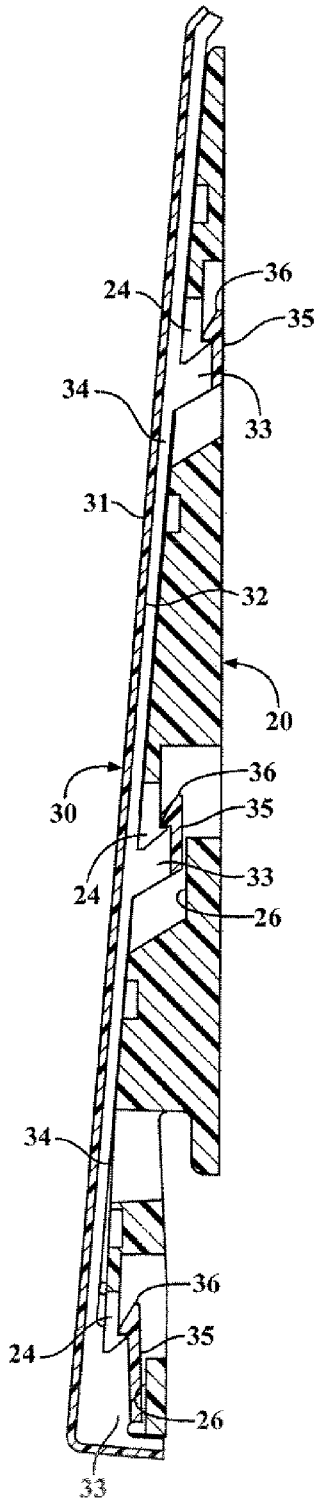
FIG. 6 is a cross-sectional view of the siding joint of FIG. 5.
Figure 10:
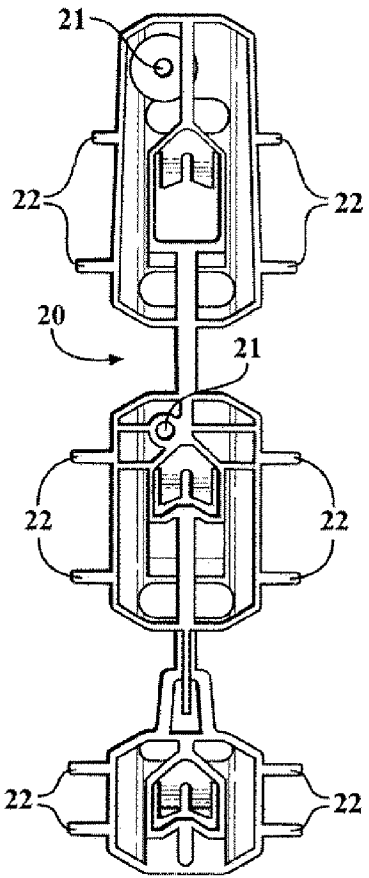
FIG. 10 is a rear view of the bottom portion of the siding joint of FIG. 5.

Openings 23 corresponding approximately in shape to each of the feet 35 are also provided through the bottom portion 20. Extending into each such opening 23 at the forward portion thereof are a pair of locking tabs 24 separated by an elongated opening 25. Two of the three openings 23 are further characterized by the presence of a stop surface 26 as best shown in FIGS. 6 and 9.

Figure 5:
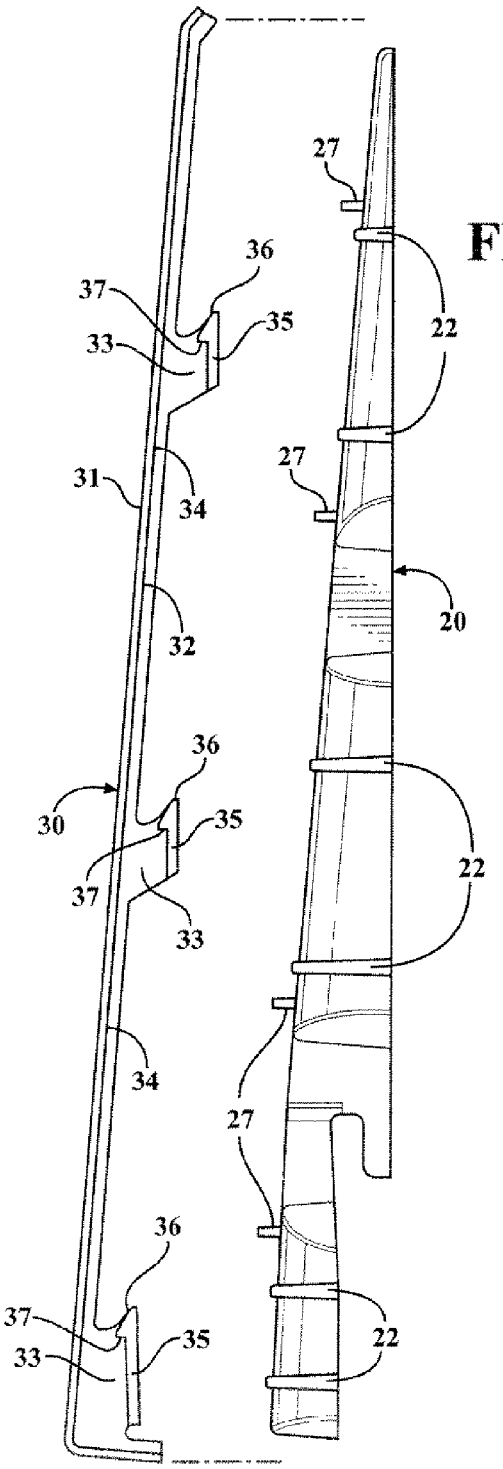
FIG. 5 depicts in lateral view the top and bottom portions of the siding joint according to the instant invention.
Figure 9:
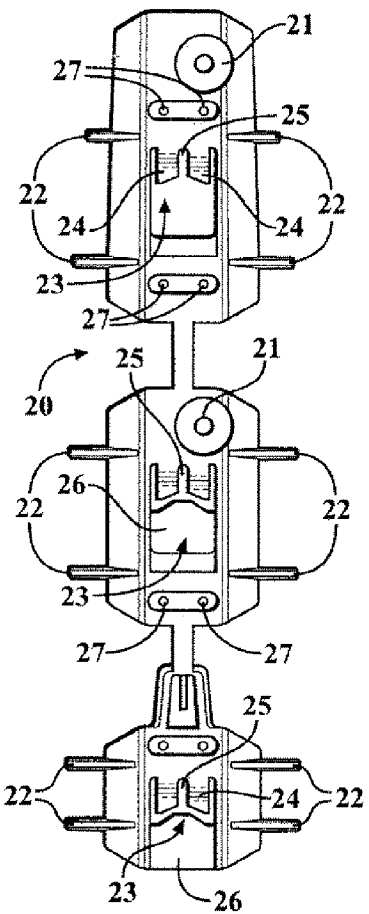
FIG. 9 is a front view of the bottom portion of the siding joint of FIG. 5.
Figure 8:
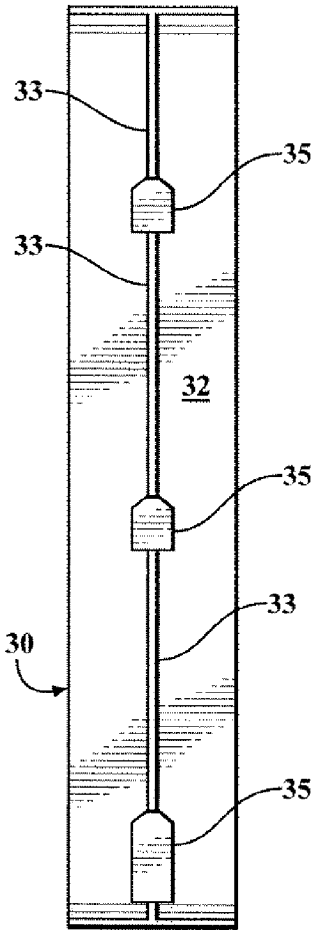
FIG. 8 is a rear view of the top portion of the siding joint of FIG. 5.
Figure 7:
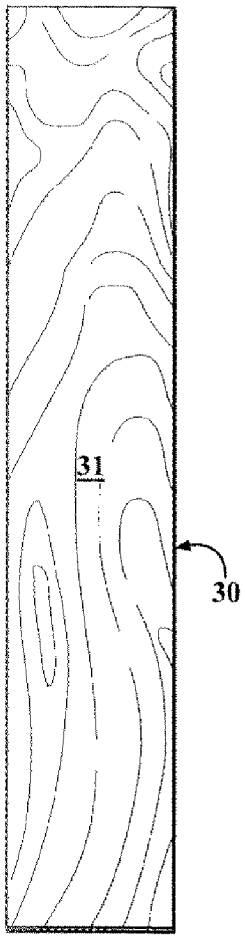
FIG. 7 is a front view of the top portion of the siding joint of FIG. 5.

Referring specifically to FIGS. 5 and 9, the upper surface of the bottom portion 20 further includes several projections 27.

As shown, the projections 27 are disposed in laterally spaced-apart pairs. Each such projection 27 extends upwardly a sufficient distance so as to abut the opposing lateral edges of horizontally adjacent pieces of siding panel during installation thereof, as explained further below. Each such projection 27 is preferably fabricated so as to be either frangible or deformable in response to the force of a siding panel's lateral edge acting against the projection 27 during expansion of the panel as occasioned by changes in ambient temperatures.

Figure 12:
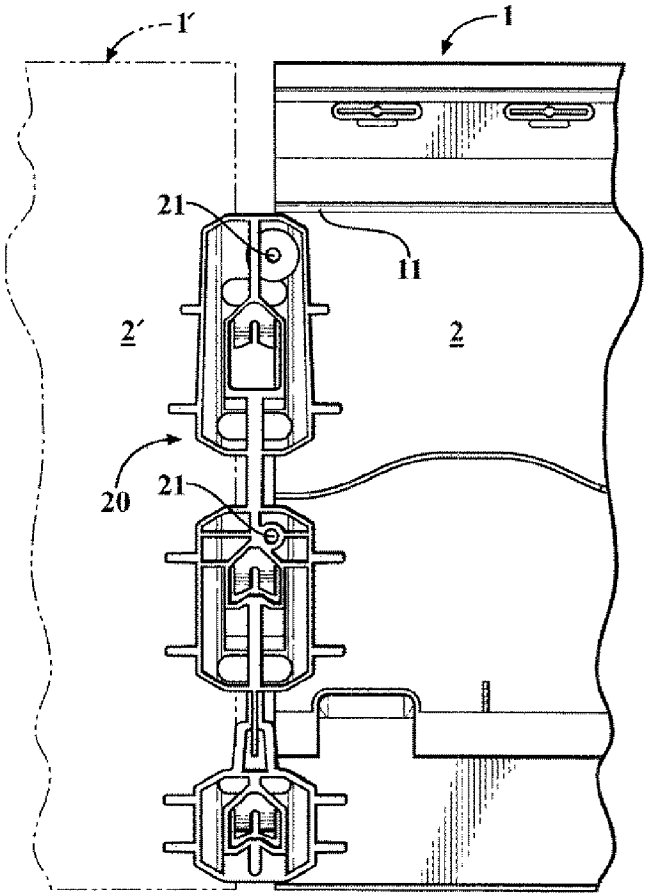
FIG. 12 is a rear view showing the bottom portion of the siding joint of the present invention in position beneath the edges of laterally adjacent pieces of polymer siding (one of which is shown entirely in phantom lines)
Figure 11:
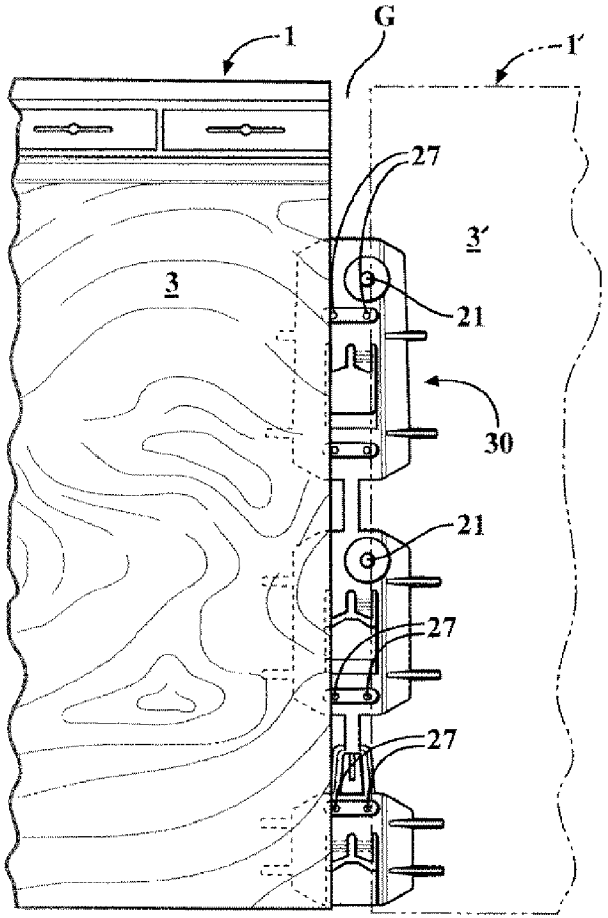
FIG. 11 is a front view showing the bottom portion of the siding joint of the present invention in position beneath the edges of laterally adjacent pieces of polymer siding (one of which is shown entirely in phantom lines)

Turning now to FIGS. 11 and 12, the manner of employment and operation of the inventive siding joint will be better understood.

According to convention, rows of siding panels (e.g., 1, 1') are installed on a substrate (not shown) in horizontally-adjacent fashion, with a sufficient distance left between the opposing edges of horizontally-adjacent panels so as to accommodate thermal expansion of these panels following securement thereof to the substrate. Following placement and installation of a first siding panel 1, the bottom portion 20 is positioned and installed on the substrate proximate the lateral edge of the siding panel 1. To facilitate such installation, the installer positions the bottom portion 20 against the substrate (not shown) and partially beneath the siding panel 1 so that the lateral edge of the siding panel abuts the nearest of the pairs of projections 27. To further facilitate precise placement of the bottom portion 20, there may, as shown in FIG. 12, be provided one or more stops 11, stand-offs or the like on the rear surface 2 of each siding panel which are adapted to contact the top edge of the bottom portion 20, as depicted.

Following placement, fasteners are driven through the offset openings 21 to fix the bottom portion 20 to the substrate. Thereafter, the next horizontally adjacent siding panel 1' is positioned and installed. Positioning relative to the bottom portion 20 is again facilitated using the projections 27, with the lateral edge of the siding panel 1' being arranged so as to abut the nearest of the pairs of such projections 27.

After the siding panel 1' is fixed in place on the substrate, the top portion 30 (not depicted in FIGS. 11 and 12) is mated to the bottom portion 20. This is accomplished by positioning the top portion proximate the bottom edges of the siding panels 1, 1' such that the front, outwardly-facing decorative surface 31 is disposed above the front surface 3, 3' of each siding panel 1, 1', the supports 33 are aligned with the gap G defined between the adjacent, installed siding panels 1, 1', and the feet 35 are positioned beneath the rear surface (not shown) of each siding panel 1, 1'. Thereafter, the top portion 30 is slid upwardly toward the bottom portion 20 until each of the feet 35 is positioned above a corresponding one of the openings 23. The top portion 30 is then urged downwardly until the feet 35 confront stop surfaces 26, whereupon the top portion 20 is urged upwardly once more to force tabs 24 over the forward edge 36 of each foot 35 and into locking engagement against the surface 37.

Figure 13:
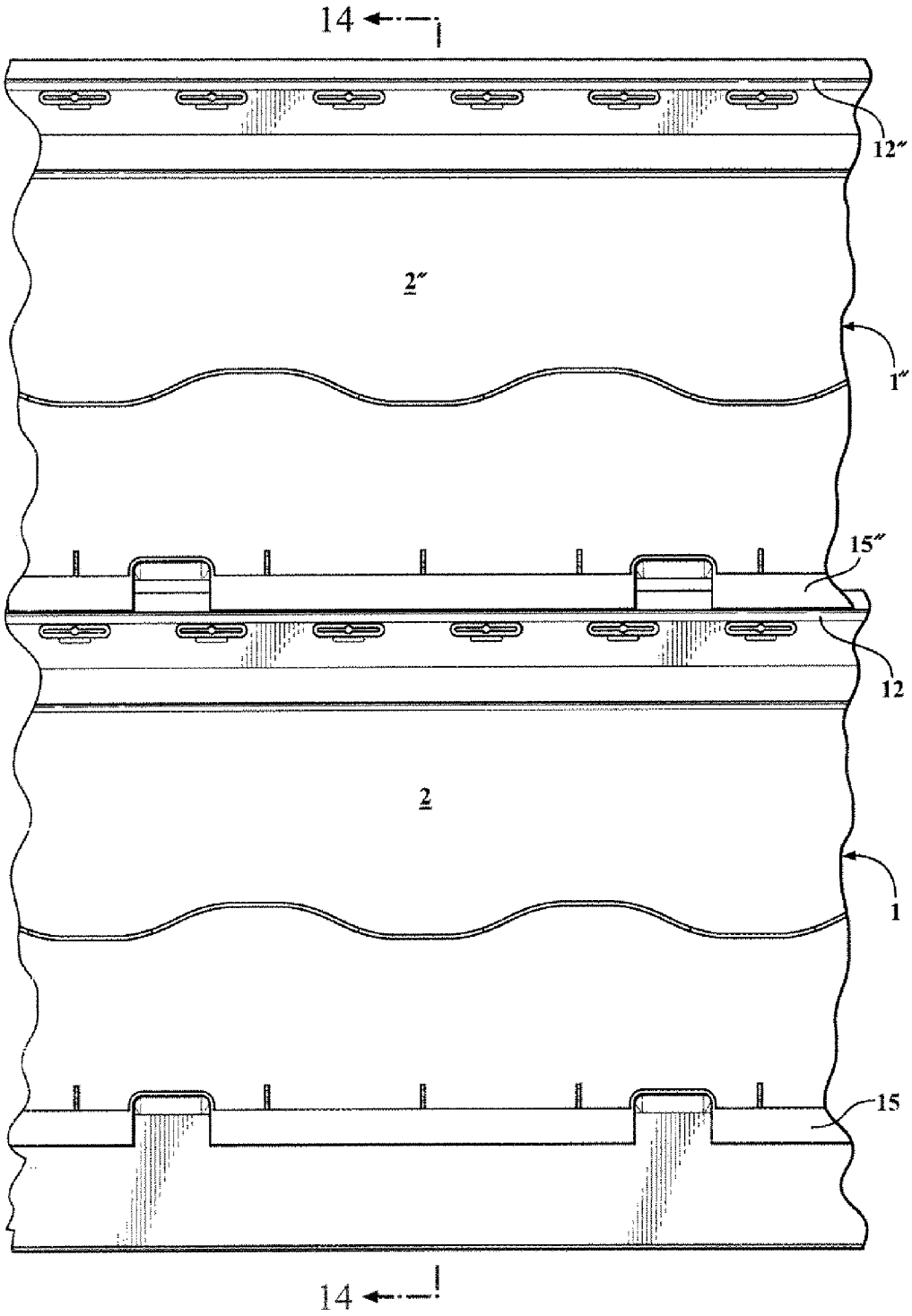
FIG. 13 is a rear plan-view showing the engagement of vertically adjacent siding panels according to the present invention.
Figure 14:
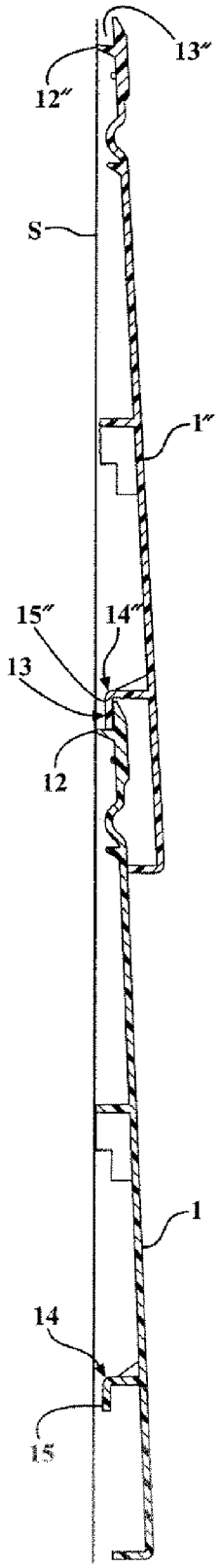
FIG. 14 is a cross-sectional view of the siding panels of FIG. 13, taken along lines 14.

Referring next to FIGS. 3, 13 and 14, a further improved building product according to the present disclosure comprises the provision of a unique profile for siding panels (1, 1"), as depicted, or roofing panels, which permits such panels to be easily and accurately positioned vertically-adjacent each other. As shown best in FIGS. 3 and 14, there is provided proximate the top edge of each siding panel 1, positioned above the elongate slot defined by peripheral wall 5, a rearwardly projecting stand-off 12 which serves to contact the substrate upon installation of the siding and so maintain between the siding panel 1 and the substrate a gap 13 defined in the area immediately above the stand off 12. Along the length of the siding panel 1 the gap 13 defines, upon installation of the siding panel, an upwardly-opening channel. But while the stand-off 12 is shown as a continuous element extending generally coextensively with the length of the siding panel, it will be understood that a plurality of discrete ones of such stand-offs may instead be provided, each positioned along the length of the panel.

Referring particularly to FIG. 14, there is provided proximate the bottom of each siding panel 1,1" a rearwardly projecting element 14 which terminates in a downwardly extending portion 15 to define, in cross-section, a substantially "L"-shaped hook. This element 14 may extend continuously across the length of the siding panel 1, 1" or, alternatively, may be formed as one of a plurality of discrete ones of such elements positioned along the length of the panel.

In operation, which may be best understood with reference to FIG. 14, a first siding panel 1 is installed against a substrate S, with the stand-off 12 defining the gap 13 in the area above the stand-off 12 and between the top edge of the siding panel and the substrate. In placing the next vertically-adjacent siding panel 1", an installer simply slides the panel 1" downwardly towards the previously installed panel 1 until the downwardly extending portion 15 of element 14 is received in the gap 13 and abuts against the stand-off 12, thus indicating accurate placement of the panel 1' relative to the panel 1. The panel 1' may then be fixed in place against the substrate and the siding panel installation process repeated.

It will be appreciated from the foregoing disclosure that the present invention provides polymer building products which facilitate the accurate and rapid installment thereof.

Of course, the preceding specification is merely illustrative of the present invention, and those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. In polymer building products, such as polymer siding, polymer roofing, j-blocks, gable vents, etc., characterized by fastener apertures each comprising an elongate slot bounded by a peripheral wall defining the slot, the peripheral wall having a height, the improvement comprising: a fastener centering-guide comprising a layer of material extending into the elongate slot from the peripheral wall thereof, the layer of material having defined therein (a) an elongate opening that is generally parallel to, but of smaller transverse dimensions than, the elongate slot, and (b) a predetermined location, defined intermediate the length of the elongate opening, for receiving a fastener therethrough, and wherein further the layer of material is characterized by a thickness that is less than the height of the peripheral wall and sufficiently thin so as to permit relative movement between a fastener extending through the centering guide and the polymer building product.

2. The improved polymer building product of claim 1, wherein the predetermined location for receiving a fastener through the layer of material comprises an opening of a first size, and the elongate opening comprises a pair of slots extending oppositely from the opening, each slot being characterized by smaller transverse dimensions than the opening.

3. The improved polymer building product of claim 1, wherein the layer of material is formed of polymer.

4. The improved polymer building product of claim 1, wherein the layer of material is formed integrally with the peripheral wall.

5. The improved polymer building product of claim 1, wherein the layer of material is a separate element that is fixedly secured to the peripheral wall.

6. In polymer building products, such as polymer siding, polymer roofing, j-blocks, gable vents, etc., characterized by fastener apertures each comprising a elongate slot bounded by a peripheral wall defining the slot, the peripheral wall having a height, the improvement comprising: a hammer stop for limiting the depth to which a fastener may be driven into each elongate slot, the hammer stop comprising vertically elevated, rigid stop surfaces, the stop surfaces positioned about each elongate slot so as to confront the face of a hammer having a head diameter greater than the distance between the stop surfaces, and the stop surfaces being vertically elevated above each elongate slot by a distance sufficient to prevent a fastener from being driven into the slot to a depth at which the building product is prevented from moving relative to the fastener during expansion and contraction of the building product.

7. The improved polymer building product of claim 6, wherein the hammer stop comprises a pair of elongate ribs disposed oppositely of the elongate slot and longitudinally extending in a direction generally parallel to the longitudinal axis of the elongate slot.

8. The improved polymer building product of claim 7, wherein the fastener apertures are disposed serially along a length of the building product, and wherein the improvement further comprises the pair of elongate ribs extending continuously and generally coextensively with the fastener apertures.

9. A polymer roofing or siding panel, comprising: a front, outwardly-facing decorative surface and an opposite, rearwardly facing surface, a top edge and a vertically spaced-apart bottom edge; a first stand-off positioned proximate the top edge of the roofing or siding panel, the stand-off projecting rearwardly from the rearwardly facing surface, and the stand-off engageable with a substrate to define a gap between the siding or roofing panel and a substrate in the area immediately above the stand-off; a hook positioned proximate the bottom edge of the roofing or siding panel and projecting from the rearwardly facing surface thereof, the hook opening toward the bottom edge of the roofing or siding panel so as to be slidingly receivable in the said gap defined in a like, vertically adjacent roofing or siding panel.

10. The polymer roofing or siding panel of claim 9, wherein the first stand-off is a continuous element extending generally coextensively with the length of the roofing or siding panel.

11. The polymer roofing or siding panel of claim 9, wherein the hook is defined by a rearwardly projecting element that terminates in a portion extending downwardly toward the bottom edge of the roofing or siding panel.

12. The polymer roofing or siding panel of claim 11, wherein the hook is a continuous element extending generally coextensively with the length of the roofing or siding panel.

13. The polymer roofing or siding panel of claim 11, wherein the hook is a discrete element disposed along the length of the roofing or siding panel.

14. The polymer roofing or siding panel of claim 13, wherein a plurality of discrete hooks are disposed along the length of the roofing or siding panel.

15. A siding joint for concealing the gap between opposing lateral edges of horizontally adjacent pieces of siding, the siding joint comprising:

a bottom portion in the form of a generally wedge-shaped element that tapers in thickness along a longitudinal axis thereof, the bottom portion adapted to be secured to a substrate beneath, and proximate the opposite lateral edges of, horizontally adjacent pieces of siding; and a top portion connectable to the bottom portion so as to capture therebetween horizontally adjacent pieces of siding, the top portion concealing the opposing lateral edges of horizontally adjacent pieces of siding.

16. The siding joint of claim 15, wherein the top portion comprises an outwardly-facing surface simulating the appearance of a natural siding material.

17. The siding joint of claim 15, wherein the top and bottom portions comprise interlocking elements by means of which the top portion is connectable to the bottom portion.

18. The siding joint of claim 15, wherein the bottom portion further comprises a plurality of laterally extending ribs dimensioned to be able to support overlying siding.

19. A siding joint for concealing the gap between opposing lateral edges of horizontally adjacent pieces of siding, the siding joint comprising:

a bottom portion adapted to be secured to a substrate beneath, and proximate the opposite lateral edges of, horizontally adjacent pieces of siding, the bottom portion including a plurality of spaced openings therein, and at least one locking tab extending into each said opening; and a top portion connectable to the bottom portion so as to capture therebetween horizontally adjacent pieces of siding, the top portion concealing the opposing lateral edges of horizontally adjacent pieces of siding, and the top portion including a plurality of rigid supports corresponding in number to the number of the plurality of openings in the bottom portion, each said rigid support terminating in a foot engageable by the at least one tab in the corresponding opening in the bottom portion.

20. The siding joint of claim 19, wherein the top portion comprises an outwardly-facing surface simulating the appearance of a natural siding material.

21. The siding joint of claim 19, wherein the top and bottom portions comprise interlocking elements by means of which the top portion is connectable to the bottom portion.

22. The siding joint of claim 19, wherein the bottom portion further comprises a plurality of laterally extending ribs dimensioned to be able to support overlying siding.

23. A siding joint for concealing the gap between opposing lateral edges of horizontally adjacent pieces of siding, the siding joint comprising:

a bottom portion adapted to be secured to a substrate beneath, and proximate the opposite lateral edges of, horizontally adjacent pieces of siding, the bottom portion including a plurality of laterally spaced-apart deformable or frangible projections dimensioned to abut the opposing lateral edges of horizontally adjacent pieces of siding, said projections adapted to be deformable or frangible in response to the force of a siding panel's lateral edge acting against the projections during expansion of the panel as occasioned by changes in ambient temperature; and a top portion connectable to the bottom portion so as to capture therebetween horizontally adjacent pieces of siding, and the top portion concealing the opposing lateral edges of horizontally adjacent pieces of siding.

24. The siding joint of claim 23, wherein the top portion comprises an outwardly-facing surface simulating the appearance of a natural siding material.

25. The siding joint of claim 23, wherein the top and bottom portions comprise interlocking elements by means of which the top portion is connectable to the bottom portion.

26. The siding joint of claim 23, wherein the bottom portion further comprises a plurality of laterally extending ribs dimensioned to be able to support overlying siding.

* * * * *

UNITED STATES PATENT AND TRADEMARK OFFICE
Certificate

Patent No. 8,020,353 B2 Patented: September 20, 2011

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Michel Gaudreau, Quebec (CA); Louis-André Gaudreau, Quebec (CA); François Lagloire, Quebec (CA); René Bilodeau, Quebec (CA); and Guillaume Alarie, Quebec (CA).

Signed and Sealed this Seventh Day of January 2014.

BRIAN GLESSNER
Supervisory Patent Examiner
Art Unit 3633
Technology Center 3600